US008833605B2

(12) United States Patent
Mehus et al.

(10) Patent No.: US 8,833,605 B2
(45) Date of Patent: Sep. 16, 2014

(54) PRODUCT DELIVERY AND MONITORING SYSTEM

(75) Inventors: Richard J. Mehus, Richfield, MN (US); Robert D. Grapes, Palmerston North (NZ); James Unwin, Palmerston North (NZ)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/184,801

(22) Filed: Jul. 18, 2011

(65) Prior Publication Data

US 2012/0018448 A1 Jan. 26, 2012

Related U.S. Application Data

(60) Provisional application No. 61/365,881, filed on Jul. 20, 2010.

(51) Int. Cl.

| | |
|---|---|
| ***B67B 7/00*** | (2006.01) |
| ***B67D 1/00*** | (2006.01) |
| ***B67D 7/02*** | (2010.01) |
| ***A47L 15/00*** | (2006.01) |
| *A47L 15/44* | (2006.01) |

(52) U.S. Cl.

CPC ..... *B67D 7/0266* (2013.01); *A47L 2401/023* (2013.01); *A47L 15/4418* (2013.01); *A47L 2501/26* (2013.01); *A47L 15/0055* (2013.01)

USPC ..... 222/1; 222/63; 222/135

(58) Field of Classification Search

USPC ..... 222/63, 135, 1; 134/56 D, 113

See application file for complete search history.

(56) References Cited

U.S. PATENT DOCUMENTS

| | | | |
|---|---|---|---|
| 2,830,615 | A | 4/1958 | Borell et al. |
| 2,859,760 | A | 11/1958 | Borell |
| 3,399,813 | A | 9/1968 | Theyssen |
| 3,645,421 | A | 2/1972 | Tuthill |

(Continued)

FOREIGN PATENT DOCUMENTS

| | | |
|---|---|---|
| JP | 07-124504 | 5/1995 |
| JP | 2003-033687 | 2/2003 |

(Continued)

OTHER PUBLICATIONS

International Search Report from corresponding PCT Application Serial No. PCT/US2011/044499, mailed Feb. 23, 2012, 3 pages.

*Primary Examiner* — Kevin P Shaver
*Assistant Examiner* — Patrick M Buechner
(74) *Attorney, Agent, or Firm* — IPLM Group, P.A.

(57) ABSTRACT

A product delivery and monitoring system is provided. The system includes at least one air pump, an air pump sensor for each air pump, at least one diaphragm pump, a diaphragm pump sensor for each diaphragm pump, a controller and an indication system. Each air pump sensor is configured and arranged to monitor the operation of the air pump. The at least one diaphragm pump is configured and arranged to deliver a product in response to the operation of an associated air pump. Each diaphragm pump sensor is configured and arranged to monitor the delivery of the product by the diaphragm pump. The controller is in communication with each air pump sensor and each diaphragm pump sensor. The controller is configured to generate at least one control signal based on a comparison of communications from an air pump sensor and an associated diaphragm sensor. The controller is configured to manipulate the indication system with the at least one control signal.

17 Claims, 18 Drawing Sheets

(56) References Cited

U.S. PATENT DOCUMENTS

| | | | | |
|---|---|---|---|---|
| 3,896,827 | A | 7/1975 | Robinson | |
| 3,949,782 | A | 4/1976 | Athey et al. | |
| 4,373,863 | A | 2/1983 | Mason et al. | |
| 4,733,798 | A | 3/1988 | Brady et al. | |
| 4,756,321 | A | 7/1988 | Livingston et al. | |
| 4,966,528 | A * | 10/1990 | Henkel et al. | 417/63 |
| 5,072,473 | A | 12/1991 | Thuruta et al. | |
| 5,228,469 | A | 7/1993 | Otten et al. | |
| 5,370,743 | A | 12/1994 | Usui et al. | |
| 5,500,050 | A | 3/1996 | Chan et al. | |
| 5,681,400 | A | 10/1997 | Brady et al. | |
| 6,516,249 | B1 * | 2/2003 | Hoyle et al. | 700/282 |
| 6,591,865 | B2 | 7/2003 | Misumi | |
| 6,887,047 | B2 | 5/2005 | Grapes | |
| 7,188,754 | B2 | 3/2007 | Miefalk et al. | |
| 7,398,787 | B2 | 7/2008 | Hsu et al. | |
| 7,477,837 | B2 | 1/2009 | White, III | |
| 7,691,209 | B2 | 4/2010 | Reichold | |
| 7,753,231 | B2 * | 7/2010 | Giles et al. | 222/14 |
| 2005/0236019 | A1 * | 10/2005 | Bang | 134/56 D |
| 2006/0117811 | A1 | 6/2006 | Kinnetz | |
| 2006/0130878 | A1 * | 6/2006 | Lee et al. | 134/18 |
| 2006/0162744 | A1 * | 7/2006 | Walkden | 134/25.2 |
| 2008/0251533 | A1 * | 10/2008 | Giles et al. | 222/14 |
| 2009/0125736 | A1 * | 5/2009 | Woo | 713/320 |
| 2009/0133727 | A1 * | 5/2009 | Cerruti et al. | 134/56 D |
| 2009/0159098 | A1 * | 6/2009 | Schepers et al. | 134/18 |
| 2009/0159612 | A1 * | 6/2009 | Beavis et al. | 222/52 |
| 2009/0165822 | A1 | 7/2009 | Kintz et al. | |
| 2009/0194562 | A1 | 8/2009 | Kessler et al. | |
| 2009/0211614 | A1 * | 8/2009 | Kwon et al. | 134/113 |
| 2009/0288452 | A1 * | 11/2009 | Lee et al. | 68/12.18 |
| 2010/0155635 | A1 * | 6/2010 | Fima | 251/129.01 |
| 2010/0186781 | A1 | 7/2010 | Housmekerides et al. | |
| 2011/0290282 | A1 * | 12/2011 | Lee et al. | 134/25.2 |

FOREIGN PATENT DOCUMENTS

| | | |
|---|---|---|
| JP | 2003-182104 | 7/2003 |
| JP | 2008-193960 | 8/2008 |
| WO | WO 2005/088128 A1 | 9/2005 |

* cited by examiner

PRODUCT DELIVERY AND MONITORING SYSTEM

CROSS-REFERENCE TO RELATED APPLICATIONS

This application claims priority to U.S. Provisional Application Ser. No. 61/365,881, same title herewith, filed on Jul. 20, 2010, which is incorporated in its entirety herein by reference.

BACKGROUND

Systems such as dish machines require the delivery of specialized products during wash cycles of the machine. A typical system is automated to deliver the products to the machine at specific times during the washing cycle. One limitation in the typical system is a lack of a way to verify that the products are being delivered or whether the system is out of a particular product.

For the reasons stated above and for other reasons stated below which will become apparent to those skilled in the art upon reading and understanding the present specification, there is a need in the art for an effective and efficient system of providing product delivery and out of product information to a user.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a product delivery and monitoring system is provided. The product delivery and monitoring system includes at least one first pump, a first sensor for each first pump, at least one second pump, at least one second sensor for each second pump and a controller. Each first pump sensor is configured and arranged to monitor the operation of the at least one pump. The at least one second pump is configured and arranged to deliver a product at least in part in response to the operation of an associated first pump. Each second pump sensor is configured and arranged to monitor the delivery of the product by the at least one second pump. The controller is in communication with each first pump sensor and each second pump sensor. The controller is configured to generate at least one signal based at least in part on comparisons between communications between the controller and a first pump sensor and the controller and an associated second pump sensor.

In another embodiment, another product delivery and monitoring system is provided. The system includes at least one air pump, an air pump sensor for each air pump, at least one diaphragm pump, a diaphragm pump sensor for each diaphragm pump, a controller and an indication system. Each air pump sensor is configured and arranged to monitor the operation of the air pump. The at least one diaphragm pump is configured and arranged to deliver a product in response to the operation of an associated air pump. Each diaphragm pump sensor is configured and arranged to monitor the delivery of the product by the diaphragm pump. The controller is in communication with each air pump sensor and each diaphragm pump sensor. The controller is configured to generate at least one control signal based on a comparison of communications from an air pump sensor and an associated diaphragm sensor. The indication system is in communication with the controller. The controller is configured to manipulate the indication system with the at least one control signal.

In yet another embodiment, a method of providing a product delivery and monitoring system is provided. The method includes, monitoring operation of at least one air pump; monitoring operation of at least one diaphragm pump that delivers product, each diaphragm pump being configured and arranged to activate in response to the activation of an associated air pump; comparing activity from the at least one diaphragm pump in response to the activation of an associated air pump; and, based at least in part on the comparison, generating a select control signal.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a system that verifies a product is being delivered and indicates when the system has run out of a product. In an embodiment, a piston-type air-drive system (air pumps) provides pressure/vacuum cycles to remote diaphragm pumps with check valves. The diaphragm pumps provide select amounts of product to a machine in response to the pressure/vacuum cycle of the air pumps. Sensors in communication with the air pumps and the diaphragm pumps monitor the status of the respective air pump and diaphragm pump and send status communications to a controller that processes the information and provides an output based on the processed information. In one embodiment the sensors are hall-effect sensors that monitor magnetic fields from strategically placed magnets on pistons of the air pumps and check valves in the diaphragm pumps.

Figure 1:
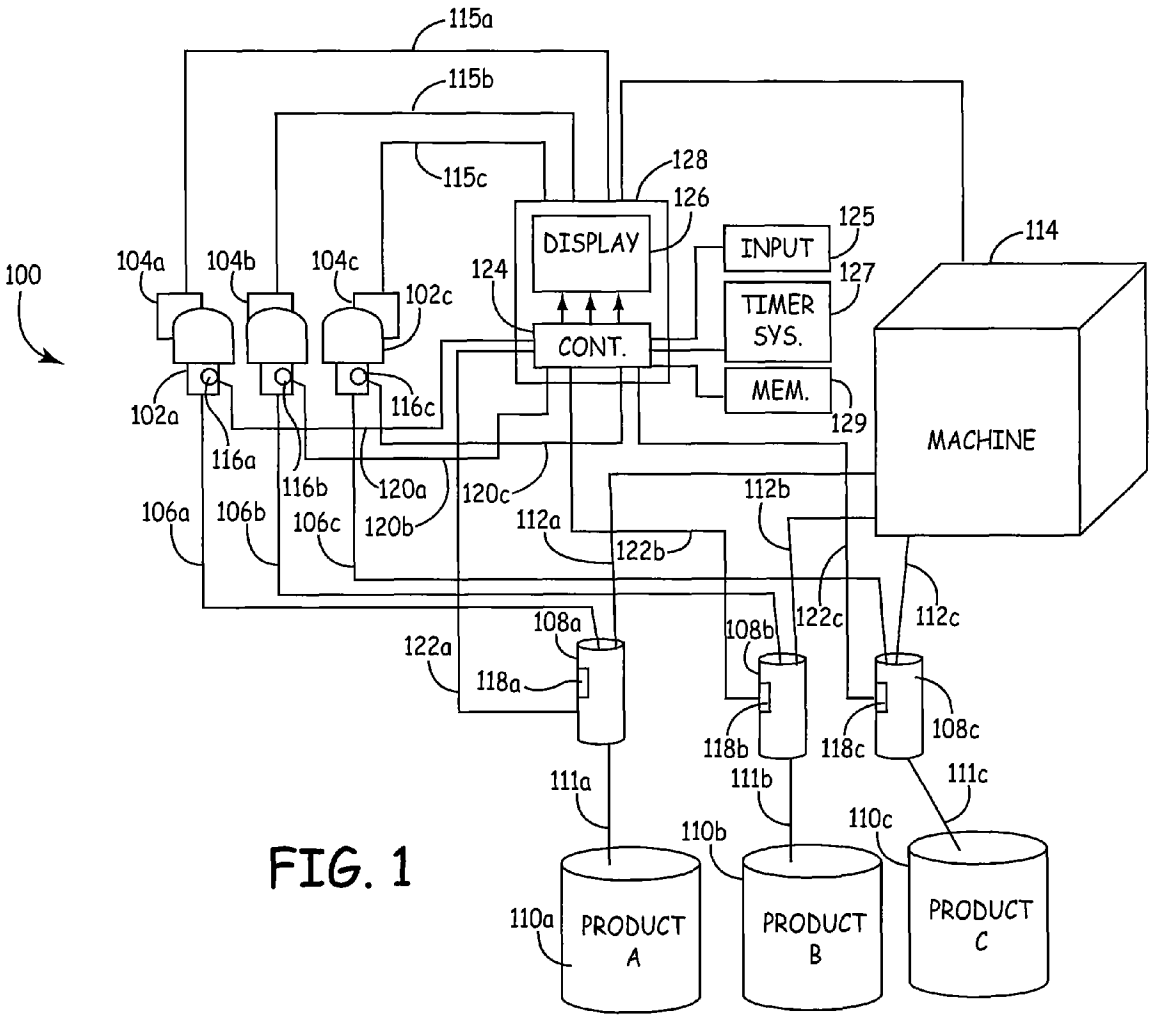
FIG. 1 is a block diagram of a product delivery and monitoring system of one embodiment of the present invention.
Figure 2:
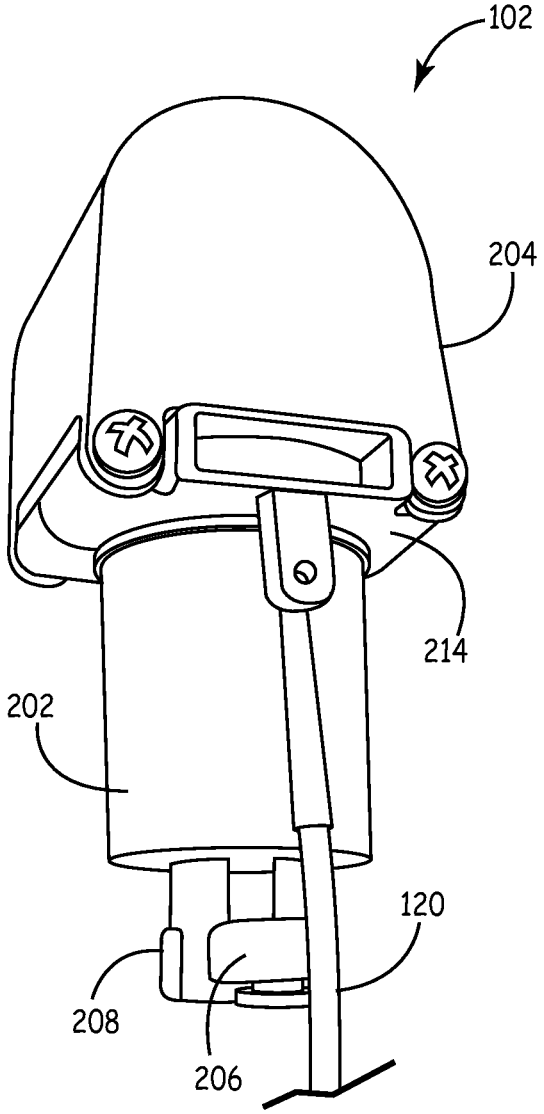
FIG. 2 is a front perspective view of an air pump of one embodiment of the present invention.
Figure 3:
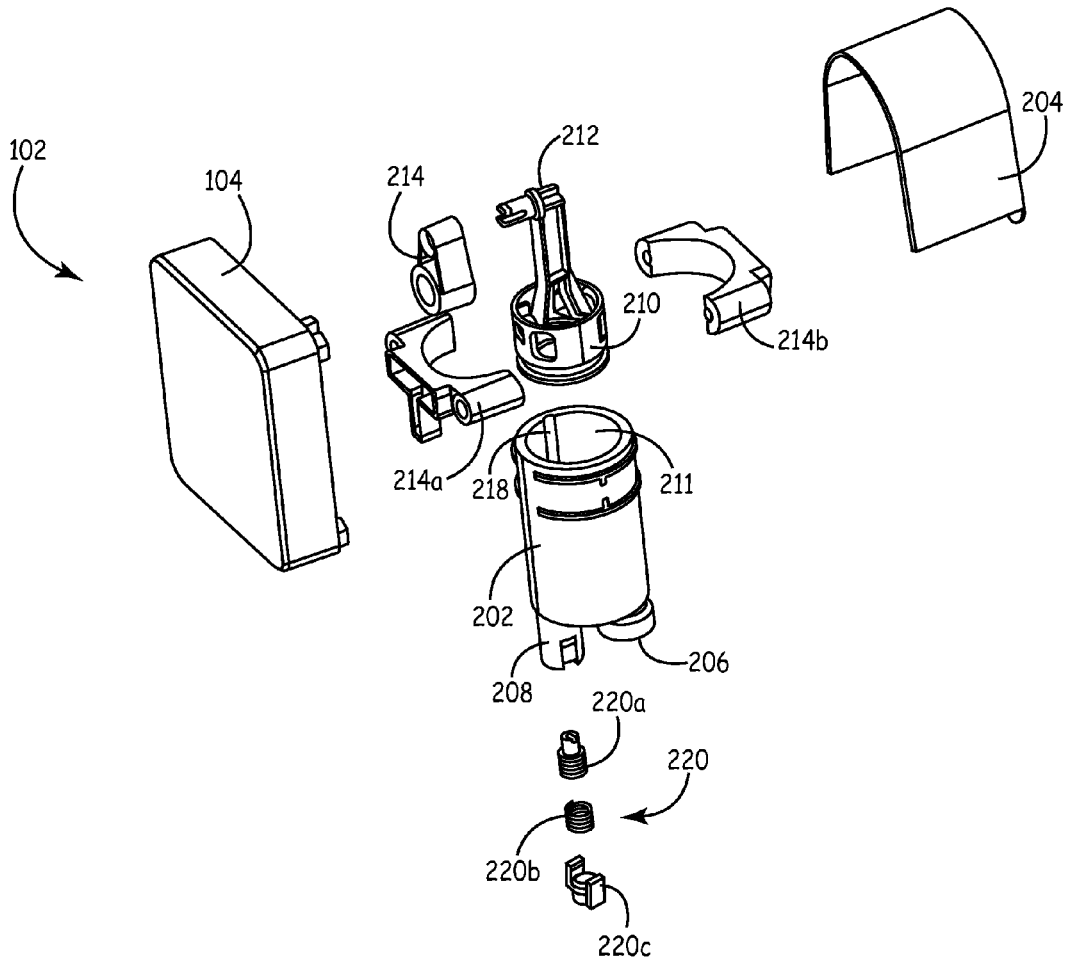
FIG. 3 is an unassembled side perspective view of the air pump of FIG. 2.

Referring to FIG. 1, an example block diagram of a delivery system and monitoring system 100 of one embodiment is illustrated. In this example, three products A, B and C from product containers 110*a*, 110*b* and 110*c* are to be supplied to machine 114 at specific times during the operation of the machine 114. Hence, this example embodiment has three pumping systems. It will be understood that the number of pumping systems will depend on the number of products needed and that the present invention is not limited to three. This example embodiment includes air pumps 102*a*, 102*b* and 102*c* that are respectively operated by motors 104*a*, 104*b* and 104*c*. In one embodiment the motors 104*a*, 104*b* and 104*c* are electrical motors having respective operational links 115*a*, 115*b* and 115*c* to a control system 128. Through the operational links 115*a*, 115*b* and 115*c*, a controller 124 of the control system 128 turns on the motors 104*a*, 104*b* and 104*c* at select times when a select product A, B and C is needed by the machine 114 as further discussed below. The air pumps 102*a*, 102*b* and 102*c* each include a piston that moves in a chamber to create a pressure stroke and a vacuum stroke (pressure/vacuum stroke). The air pumps 102*a*, 102*b* and 102*c* are further discussed below in detail. Each air pump 102*a*, 102*b* and 102*c* has an air pump sensor 116*a*, 116*b* and 116*c*. Each air pump sensor 116*a*, 116*b* and 116*c* is designed to monitor the movement of a respective piston in air pump 102*a*, 102*b* and 102*c*.

As stated above, the air pumps 102*a*, 102*b* and 102*c* provide pressure/vacuum cycles to respective pump connection tubes 106*a*, 106*b* and 106*c*. The pump connection tubes 106*a*, 106*b* and 106*c* are coupled to activate respective diaphragm pumps 108*a*, 108*b* and 108*c*. The diaphragm pumps 108*a*, 108*b* and 108*c* in response to the pressure/vacuum cycles pull product A, B and C out of the respective product containers 110*a*, 110*b* and 110*c* via pick up tubes 111*a*, 111*b* and 111*c* and supply the respective product A, B and C to the machine 114 via delivery tubes 112*a*, 112*b* and 112*c*. Diaphragm pump sensors 118*a*, 118*b* and 118*c* are coupled to the respective diaphragm pumps 108*a*, 108*b* and 108*c*. Each diaphragm pump sensor 118*a*, 118*b* and 118*c* is designed to monitor the operation of the respective diaphragm pump 108*a*, 108*b* and 108*c*. The diaphragm pump sensors 118*a*, 118*b* and 118*c* are further described in detail below.

The air pump sensors 116*a*, 116*b* and 116*c* are in communication with the controller 124 (or control logic) via air pump signal connections 120*a*, 120*b* and 120*c* respectively. Similarly, the diaphragm pump sensors 118*a*, 118*b* and 118*c* are also in communication with the controller 124 via diaphragm signal connections 122*a*, 122*b* and 122*c* respectively. The controller 124 is designed to activate a display/alarm 126 (indication system) based on signals (pulses) the controller 124 receives from the air pump sensors 116*a*, 116*b* and 116*c* and the diaphragm pump sensors 118*a*, 118*b* and 118*c*. The controller 124 and display/alarm 126 are further described below. In one embodiment, the controller 124 and the display/alarm 126 are received in the same housing 128. The embodiment of FIG. 1 further includes an input 125, a timer system 127 and a memory 129. The input 125 provides a communication to the controller 124 by a service technician to selectively control the system. In one embodiment, the input 125 includes Dual Inline Package (DIP) switches. The timer system 127 is used by the controller to time various functions of the machine 114. For example, in a dish wash machine, different cycles are needed to complete the functions of the dish wash machine such as wash, rinse and sanitizer cycles. The timer system 127 is used to time the cycles and to time events that are to occur during each cycle. In one embodiment, the timer system 127 includes cam timers. The memory 129 in one embodiment is used to store instructions to the controller 124.

Figure 4A:
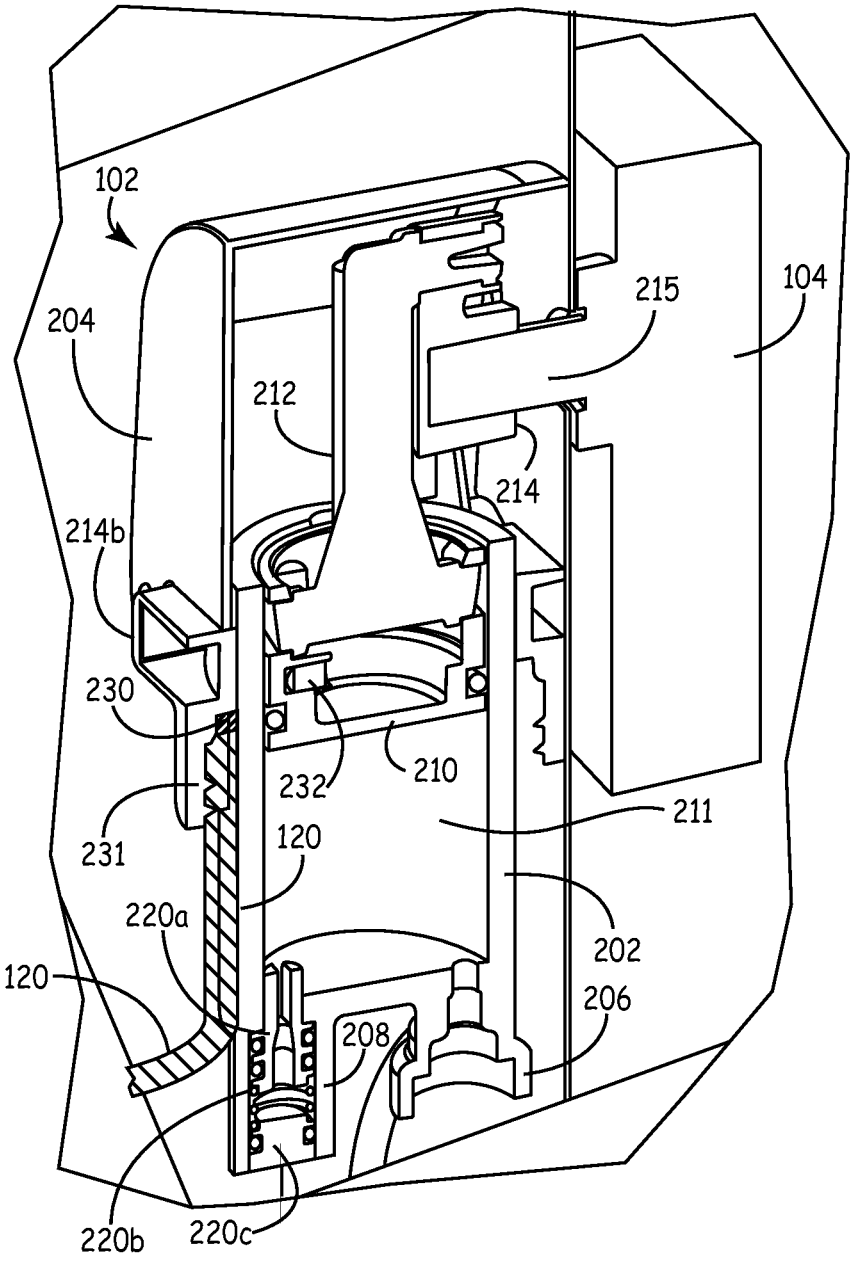
FIG. 4A is a cross-sectional side view of the air pump of FIG. 2 illustrating the piston of the air pump in a mid position in the chamber of the air pump.
Figure 4B:
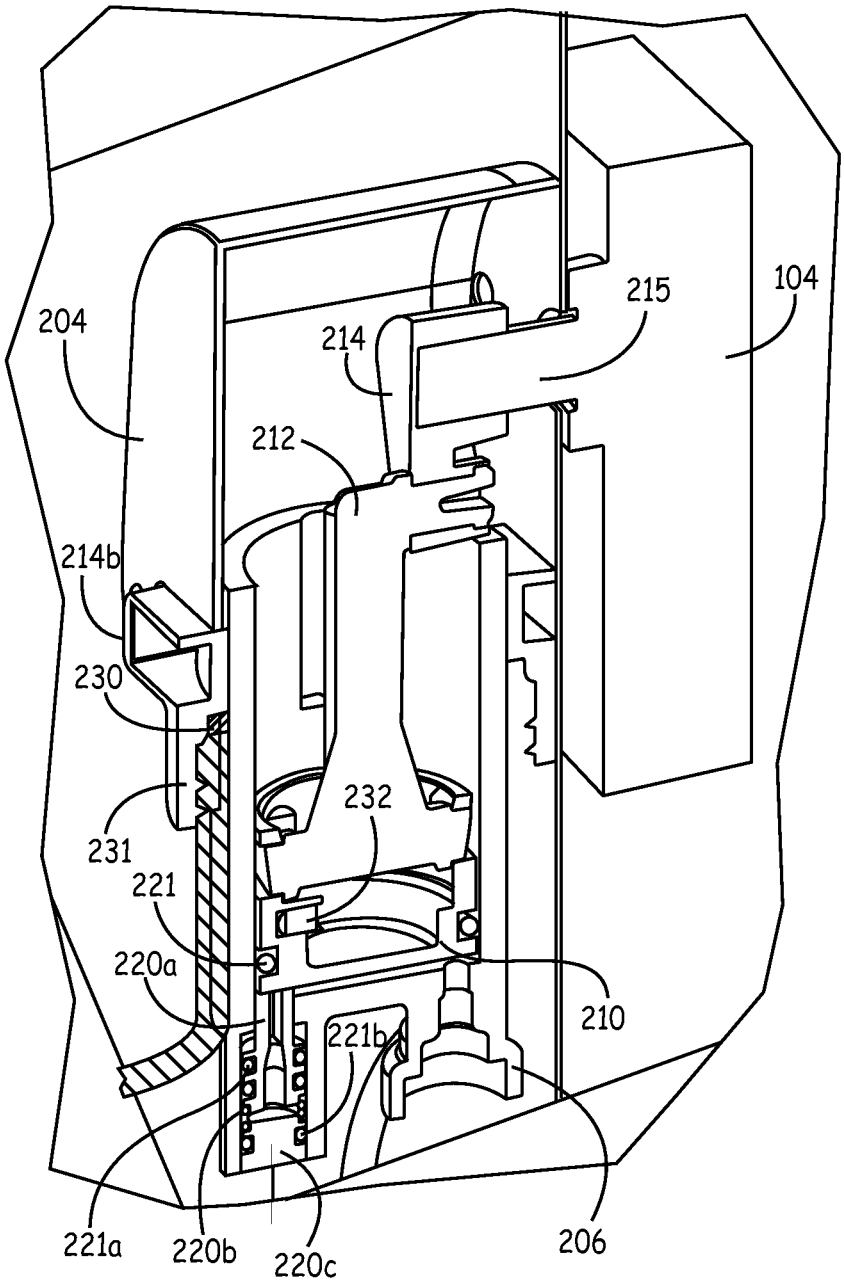
FIG. 4B is a cross-sectional side view of the air pump of FIG. 2 illustrating the piston of the air pump at the bottom of its stroke where it engages a plunger of a relief valve of the air pump.

An example of an air pump designated generally as 102 of an embodiment is illustrated in FIGS. 2 through 4B. The air pump 102 can generally be referred to as an air drive or air driver. The air pump 102 includes a cover 204 and a cylindrical housing 202. The housing 202 has an inner chamber 211 in which a piston 210 slidably engages. The piston 210 is pivotally coupled to a rod shaft 212 which is in turn rotationally coupled to a crank member 214. The crank member 214 is rotationally coupled to motor 104. Hence, when motor 216 is activated, the crank member coupled to the motor 216 moves the piston 210 in the chamber 211 to create pressure and vacuum strokes. The chamber 211 in this embodiment includes a vacuum release slot 218 that extends at least partially down the cylinder wall. One end of the cylinder housing 202 includes a pressure relief outlet port 208 and a connection port 206. Each outlet port 208 and connection port 206 extend into the chamber 211 of the housing 202. A pressure relief valve 220 is received in the pressure relief outlet port 208. The pressure relief valve 220 includes a plunger 220*a*, a biasing spring 220*b* and a retaining member 220*c*. When the piston reaches the bottom of its stroke it contacts the base of the pressure relief valve 220 thereby allowing pressure to be released from the chamber 211. This is illustrated in the cross-sectional side view of FIG. 4B. Also illustrated in FIG. 4B is seal 221 between the piston 210 and the inner chamber 211, seal 221*a* between the plunger 220*a* and the pressure relief outlet port 208 and seal 221*b* between the retaining member 220*c* and the pressure relief outlet port 208. The connection port 206 provides a connection for a pump connection tube 106. The air pump 102 is coupled to the motor 104 in this embodiment via mounting brackets 214*a* and 214*b*. Mounting bracket 214*b*, in this embodiment, includes a sensor holding portion 231. The sensor holding portion 231 holds the air pump sensor 230 (not shown in FIG. 4B) in place. It will be understood that one or more power supplies (not shown) will be used to provide power to the elements of the system 100 including motors 104*a*, 104*b*, 104*c*, the controller 124, the display/alarm 126 and the machine 114.

Figure 5A:
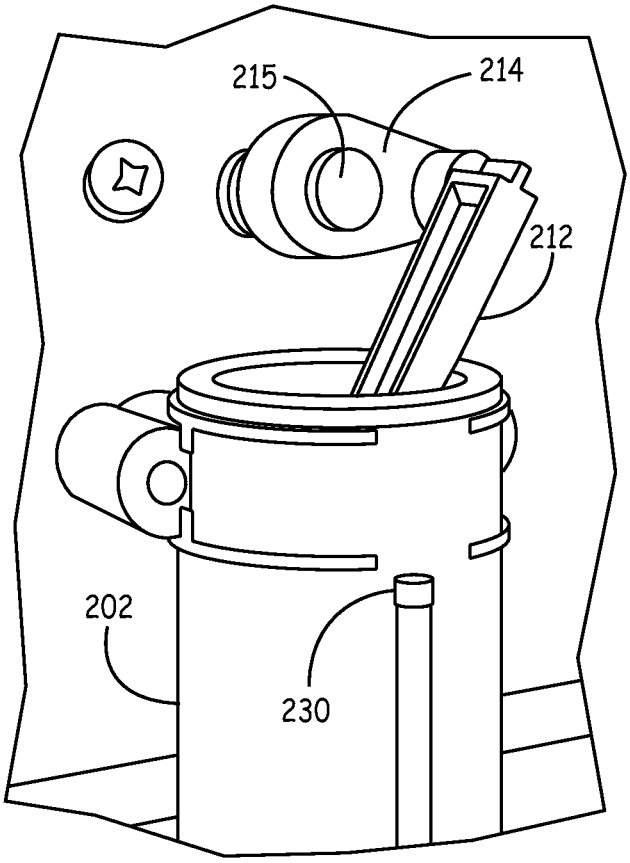
FIG. 5A is a front perspective view of the air pump of FIG. 2 without a cover.
Figure 5B:
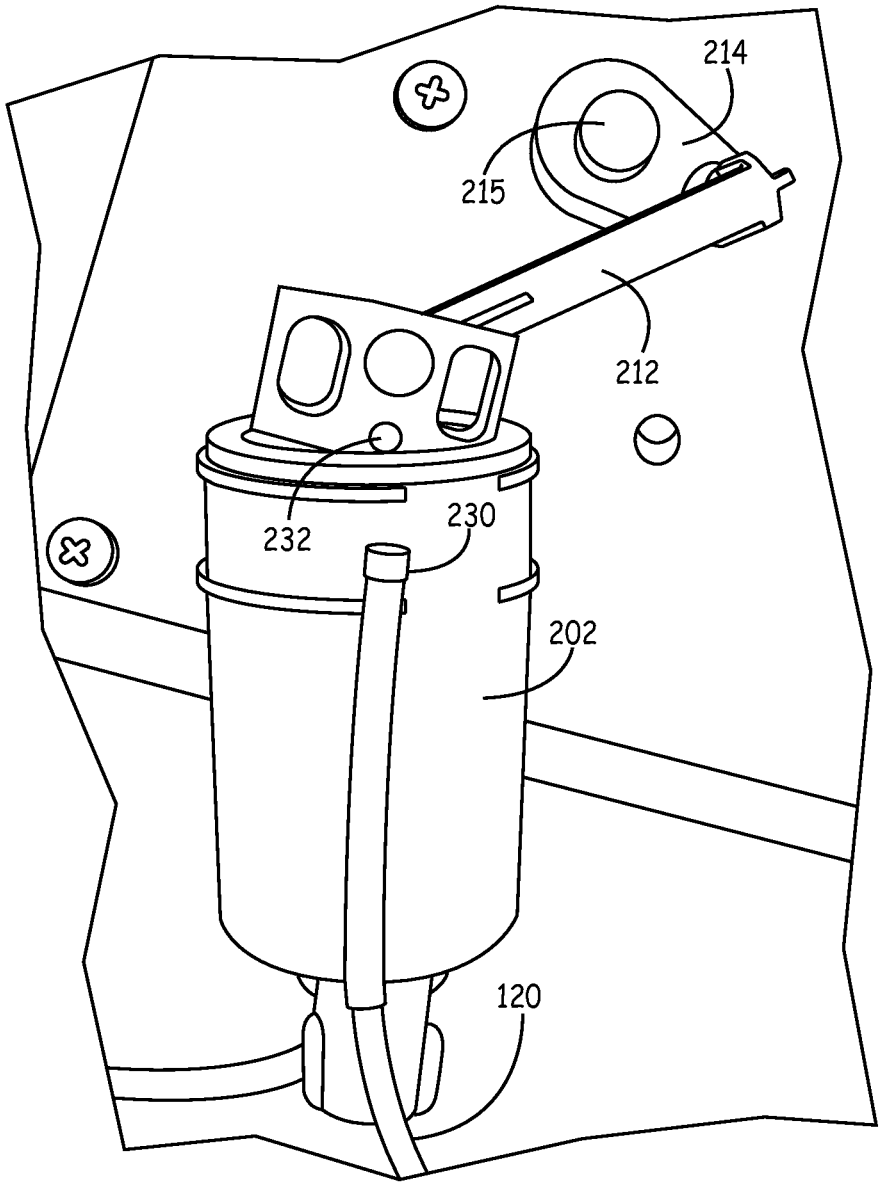
FIG. 5B is a front perspective view of the air pump of FIG. 2 illustrating a piston and magnet arrangement of one embodiment of the present invention.

Referring to FIG. 5A, an illustration of the air pump 102 without the cover 204 and without the sensor holding portion 231 of mounting bracket 214*b* is provided to give a clear view of the positioning of the air pump sensor 230 in an embodiment. In one embodiment, the air pump sensor 230 is a hall-effect sensor designed to sense magnetic fields. Further in one embodiment, the system is designed to monitor changes in the magnetic field in determining if the air pump 102 has been activated. In particular, the air pump sensor 230 is designed to generate activity pulses or driver signals based on the strength of the magnetic field it detects. Referring to FIG. 5B an illustration of the piston 210 out of the chamber 211 is provided. As illustrated, in this embodiment, a piston magnet 232 is received in a side of the piston 210. In this embodiment, when the piston magnet 232 in the piston 210 moves close to the hall-effect air pump sensor 230, the sensor 230 detects a select strength of the magnetic field produced by the magnet 232 and provides corresponding drive signals to the controller 124 via communication connection 120. Based on the drive signals received by the sensor 230, the controller 124 determines if a pump cycle has occurred by detecting shifts in the magnetic field. The controller 124 uses the driver signals along with diaphragm pulses (pump signals) discussed below in controlling when products A-C are dispensed to the machine 114 and in operating the display signal/alarm 126.

Figure 6:
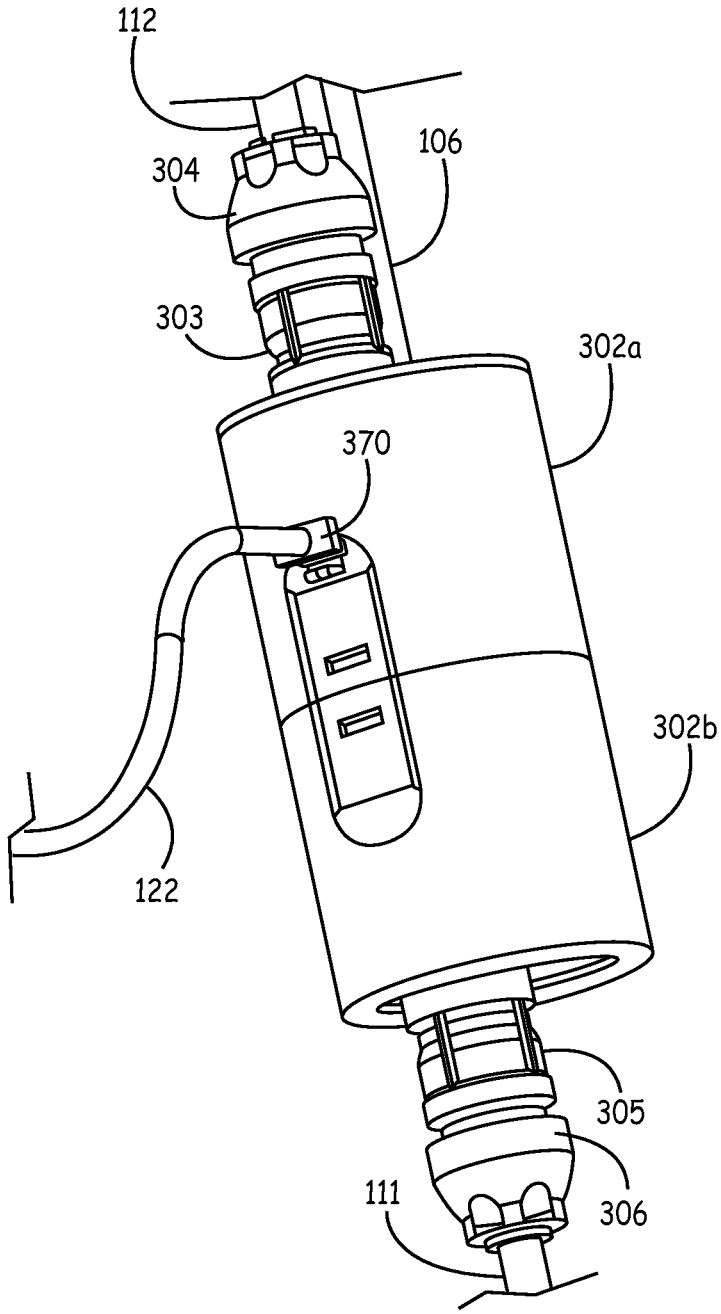
FIG. 6 is a front perspective view of a diaphragm pump of one embodiment of the present invention.
Figure 7:
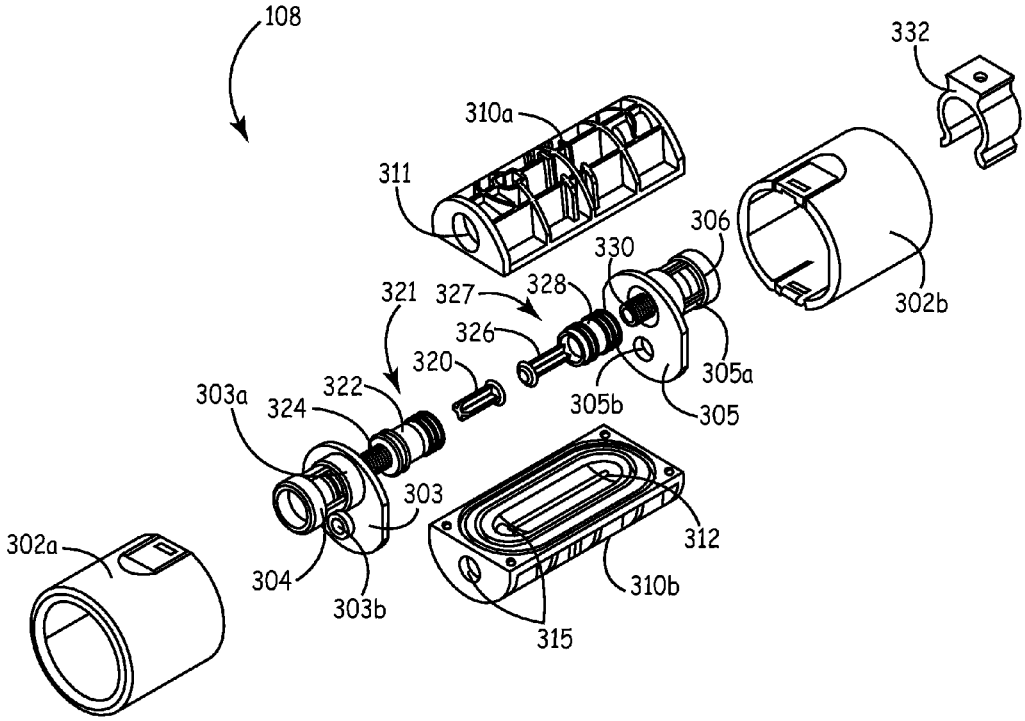
FIG. 7 is an unassembled side perspective view of the diaphragm pump of FIG. 6.

FIGS. 6 and 7 illustrate a diaphragm pump designated generally as 108 of an embodiment. The diaphragm pump 108 includes a first cover 302*a* and a second cover 302*b*. The covers 302*a* and 302*b* selectively cover first and second pump housing members 310*a* and 310*b*. As FIG. 7 illustrates, the pump housing members 310*a* and 310*b* in this embodiment have generally a half circle cross-sectional shape. When the pump housing members 310*a* and 310*b* are positioned next to each other, the housing members 310*a* and 310*b* in this embodiment form a cylindrical housing. A flat portion of each housing member 310*a* and 310*b* includes a diaphragm support surface, such as diaphragm support surface 312 on the second housing member 310*b* illustrated in FIG. 7. A diaphragm 375 (illustrated in FIG. 10) is sandwiched between opposed diaphragm support surfaces of the housing members 310*a* and 310*b*. The housing members 310*a* and 310*b* include passages, such as passages 311 and 315 that extend between select ends of the housings members 310*a* and 310*b* to respective diaphragm support surfaces 312. The passages are used to manipulate the diaphragm 375 and pump product as is understood in the art. Diaphragm movement during the pumping cycle is controlled by the internal slope of the pump chamber. This limiting of travel adds to the accuracy of the pump. Positioned near the ends of the housing members 310*a* and 310*b* are coupling members 303 and 305.

Coupling members 303 and 305 in this embodiment include main connection ports 303*a* and 305*a* and secondary ports 303*b* and 305*b* respectively. The main ports 303*a* and 305*a* each include an inner bore in which a cartridge check valve 321 is at least partially received. In particular, an inner bore of the main port 303*a* of the first coupling member 303 receives a check valve 321 that includes a valve 320, valve cartridge 322 and biasing member 324 and main port 305*a* of the second coupling member 305 receives a cartridge check valve 327 that includes valve 326, valve housing 328 and biasing member 330. The respective cartridge check valves 321 and 327 only allow passage of fluids or gas in one direction. Port connectors 304 and 306 are respectively coupled to the main ports 303*a* and 305*a* to selectively couple a product delivery tube 106 and a product pick up tube 111 to the diaphragm pump 108. The coupling members 303 and 305 are retained adjacent a respective end of the housing members 310*a* and 310*b* via a lip on a respective cover 302*a* and 302*b*. Also illustrated in FIG. 7 is bracket 332 used to mount the pump-head to a support surface (not shown).

Figure 8A:
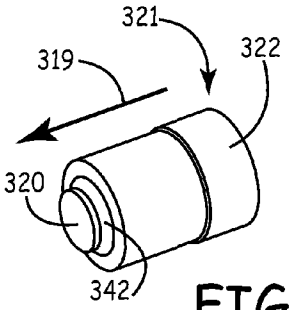
FIG. 8A is a side view perspective view of a cartridge check valve of the diaphragm pump of FIG. 6 of one embodiment of the present invention.
Figure 8B:
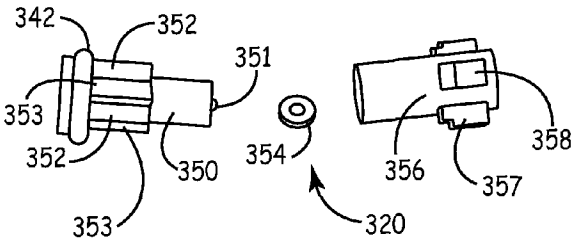
FIG. 8B is an unassembled side perspective view of a check valve of FIG. 8A.
Figure 8C:
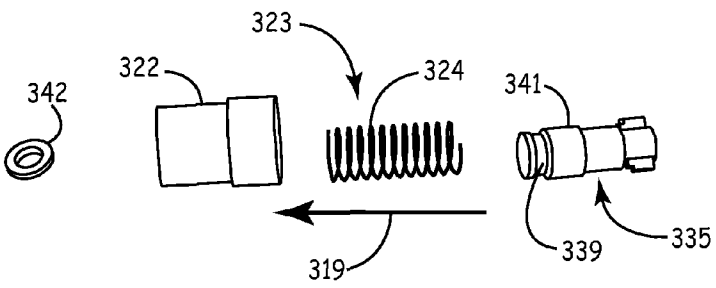
FIG. 8C is an unassembled side perspective view of a check valve of another embodiment of the present invention.
Figure 8D:
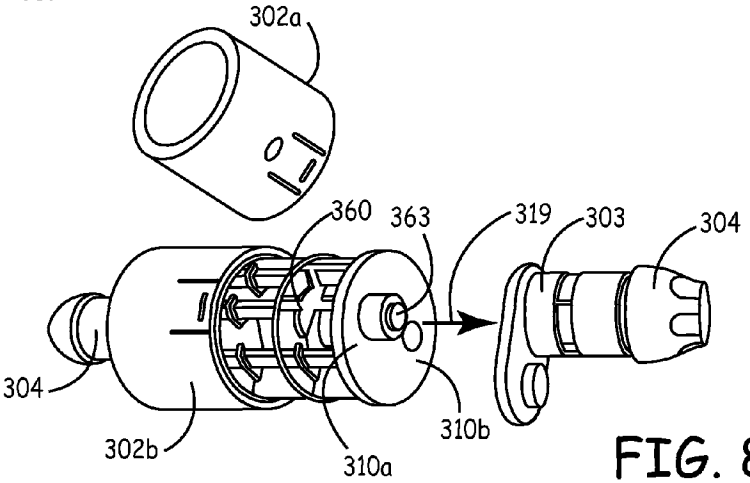
FIG. 8D is a partial unassembled side view of the diaphragm pump of FIG. 6.

Referring to FIGS. 8A and 8B a further discussion of cartridge check valve 321 that is used at a product distribution port is illustrated. The cartridge check valve 321 includes the valve cartridge 322 in which a biasing member 324 (shown in FIG. 8C) and a check valve 320 are received. The check valve 320 in this embodiment includes a first and second member 350 and 356. A seal 342 is received in a groove 339 (shown in FIG. 8C) of the first member 350 of the check valve 320. A smaller seal-spacer 354 is placed on an opposing end of the first member 350 of the check valve 326. In the embodiment of FIG. 8B, the seal-spacer 354 has a central opening that receives an extending tab 351 of the first member 350 to keep the seal spacer 354 in place. A magnet (such as magnet 309 of FIG. 10A) is placed inside a bore (not shown) in the second member 356. The magnet is used in sensing the position of the check valve 320 as discussed below. A first portion of the first member 350 of the check valve 320 is received in the bore of the second member 356 of the check valve 320. The first member 350 of the check valve 320 in the embodiment of FIG. 8B includes a second portion proximate the seal 342 that includes recessed channels 352 positioned between raised ridges 353. The recessed channels 352 provide an enhanced path for the product to flow when the seal 342 is opened in the cartridge check valve 321. In the embodiment of the unassembled cartridge check valve 323 of FIG. 8C, the check valve 335 does not include recessed channels and raised ridges. In particular, in this embodiment, portion 341 of the check valve 335 has a relatively uniform surface. FIGS. 8A and 8C also illustrate the product flow direction 319.

Figure 9:
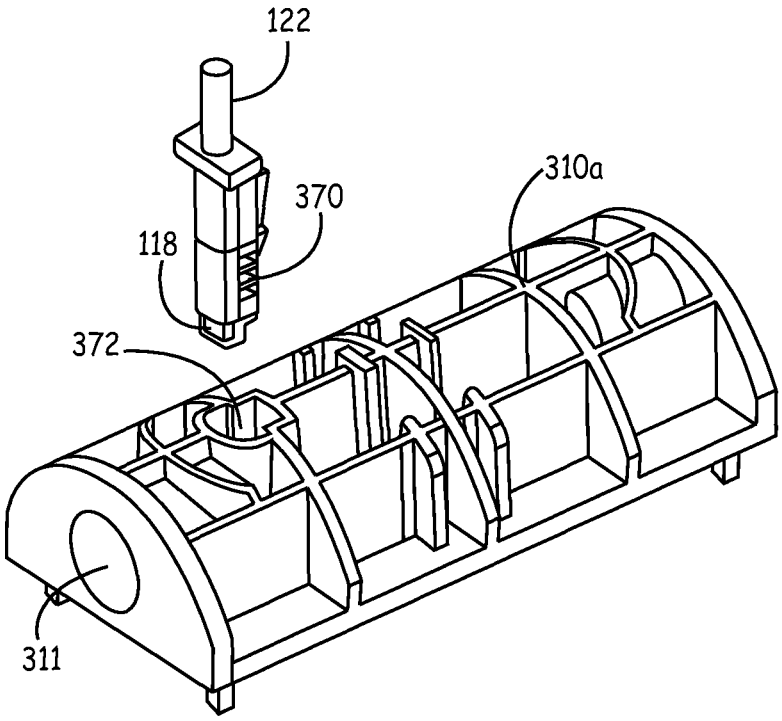
FIG. 9 is a side perspective view of a partial housing member of the diaphragm pump of FIG. 6 and the positioning of a check valve hall-effect sensor of one embodiment of the present invention.

A cartridge check valve 363 similar to cartridge check valves 321 and 323 is placed partially in a passage 311 (illustrated in FIG. 9) of a housing member 310*a* as illustrated in FIG. 8C. Another portion of the check valve 363 will be received in the main port 303*a* of coupling member 303. Also illustrated in FIG. 8C is a sensor position 360. This is a location in which a hall-effect sensor will be placed to sense the magnetic field of the magnet in the check valve 363. FIG. 9 illustrates a diaphragm sensor generally designated as 118. Sensor 118 is coupled to sensor connector 370. The sensor connector is designed to be selectively locked in sensor bore 372 in the first housing member 310. Sensor 118 is coupled to send activity pulses (signals) through diaphragm signal connection 122 which is coupled to the controller 124 as described above.

Figure 10A:
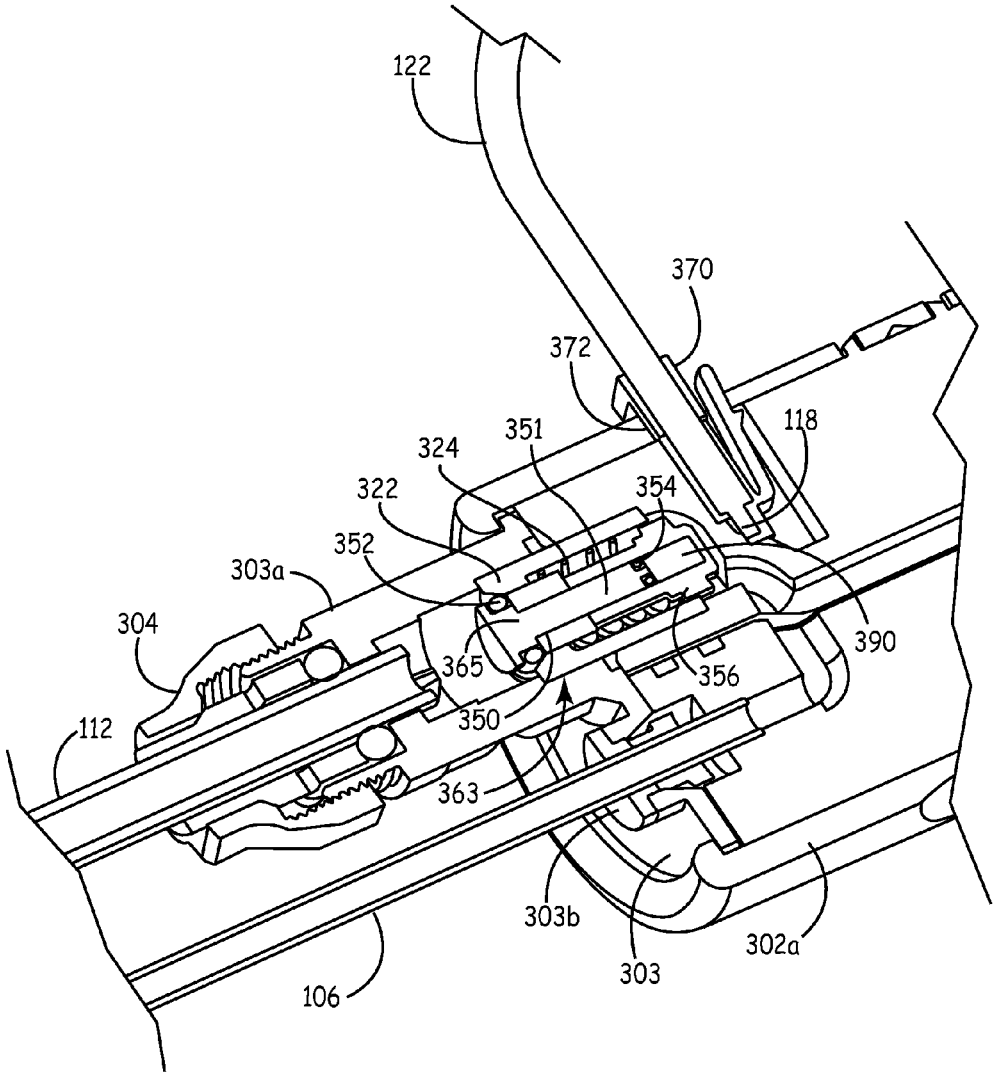
FIG. 10A is a cross-sectional side view of a portion of the diaphragm pump of FIG. 6 with a check valve in a closed position.
Figure 10B:
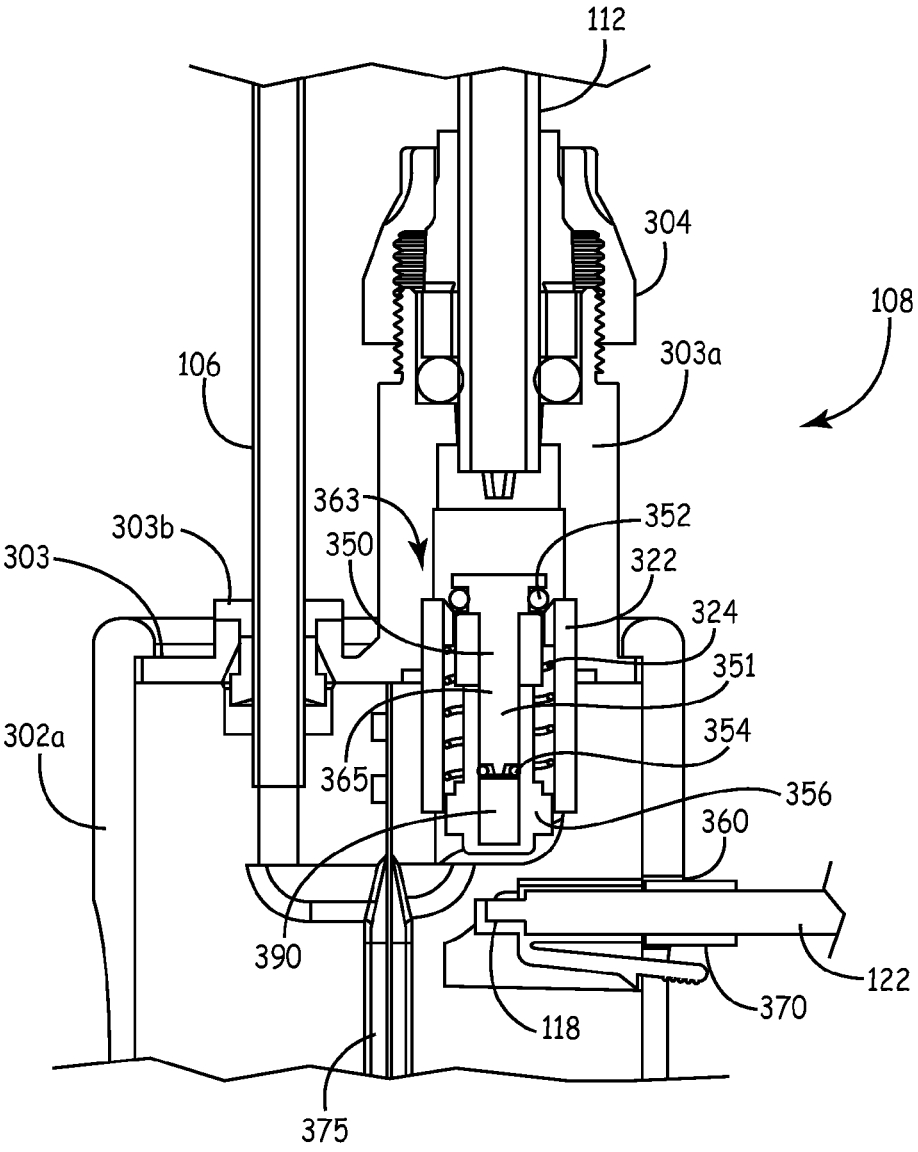
FIG. 10B is a cross-sectional side view of a portion of the diaphragm pump of FIG. 6 with a check valve in a partial open position.
Figure 10C:
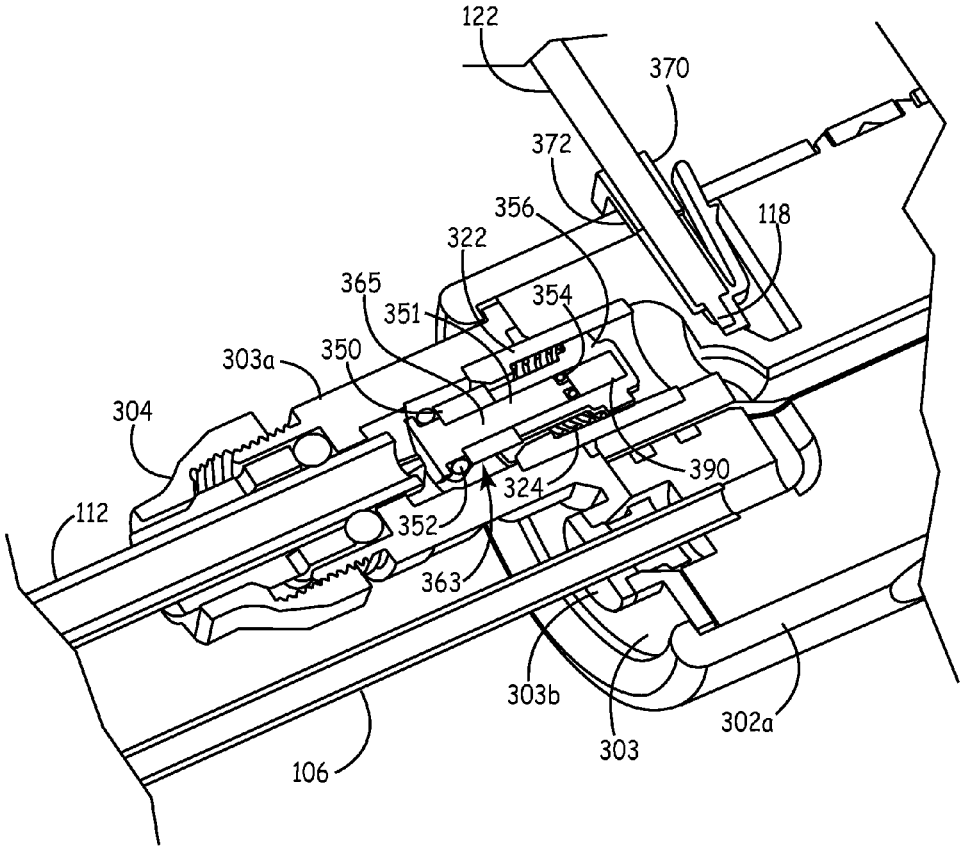
FIG. 10C is a cross-sectional side view of a portion of the diaphragm pump of FIG. 6 with a check valve in an open position.

FIGS. 10A through 10C illustrate partial cross-sectional views of the diaphragm pump 108 in an embodiment. These Figures illustrate the positioning of the diaphragm sensor 118

(hall-effect sensor) in relation to the magnet 390 of the check valve 363. The cartridge check valve 363 in this embodiment includes a valve cartridge 322 and check valve 365 (valve plunger) that includes the first member 350 and a second member 356. The magnet 390 is received in the bore in the second member 365 of the check valve 365. Also illustrated in FIGS. 10A through 10C is the main port 303*a* of the first coupling member 303 and port connector 304 that selectively couples delivery tube 112 to the diaphragm pump 108. Further illustrated is secondary port 303*b* of the first coupling member 303 that couples a pump connection tube 106 to the diaphragm pump 108. Pressure and vacuum received via the pump connection tube 106 moves the diaphragm 375 to selectively pick up product and pump it out of the main port 303*a*. The position of the check valve 365 in the valve cartridge 322 is monitored to determine when the product is pushed out of the pump 108. That is, the position of the valve 365 relative to the valve cartridge 322 (and so relative to the hall-effect device attached to the valve cartridge) is directly related to the presence or absence of the product passing through the valve. Therefore, the status of product availability directly affects the relative positioning of the check valve 365. FIG. 10A illustrates the check valve 365 in a closed position. In the closed position, seal 352 on the check valve 365 engages a lip of cartridge 322 to prevent fluid or gas from passing through the cartridge check valve 362. When the check valve 365 is in this position, the hall-effect sensor 118 senses a strong magnetic field of the magnet 390 in the check valve 365. In FIG. 10B, the seal 352 is no longer engaging the lip of cartridge 322. This position of the valve 365 would occur, for example, on a pressure stroke provided by the air driver 102 (air pump). The pressure of the air from the air driver 102 unseats the seal 352 but the valve 365 does not move far from the hall-effect sensor 118. In this position of the check valve 365, the sensor 118 senses a smaller but relatively strong magnetic field produced by magnetic 390. This position of the check valve 365 could occur when the system is out of product. In FIG. 10C, the check valve 363 is fully opened. In this configuration, the valve 365 is moved by pressure supplied by the product. In this position the product flows around the valve 365. As illustrated in FIG. 10C, the magnet 390 in the valve 365 is position farther away from sensor 118. In this position, the magnetic field detected by the sensor 118 will be weaker or non-existent. During the operation of the diaphragm pump 108, the sensor provides pump signals to the controller 124 that indicates the strength of the magnet field sensed. The information regarding the strength of the magnetic field is used by the controller 124 to determine if product is being pumped. Further discussion of this arrangement and how it works is provided in regards to FIGS. 11A through 11C below.

Figure 11A:
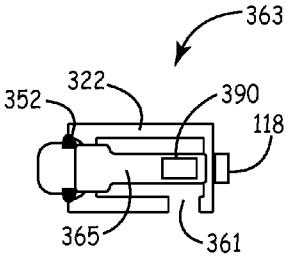
FIGS. 11A through 11C are side views of the cartridge check valves of FIGS. 10A thorough 10C in different positions in relation to a check valve hall-effect sensor of one embodiment of the present invention.
Figure 11B:
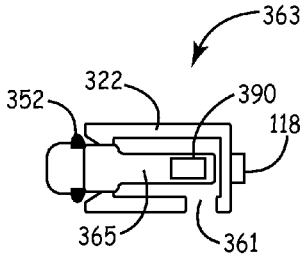
Figure 11C:
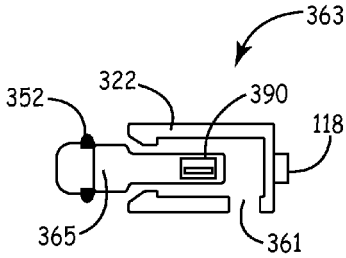

Referring to FIGS. 11A through 11C illustrations of positions of check valve 365 in a check valve assembly 363 (cartridge check valve) are further provided. In FIG. 11A the valve 365 is seated in the valve cartridge 322 and no product can pass through opening 361. In this position, sensor 118 detects the strongest magnetic field produced by the magnet 390. In FIG. 11B the valve 365 is partially opened with no product flowing through the opening 361. In this position, sensor 118 detects a somewhat smaller magnetic field produced by the magnet 390. The position of the valve 365 in FIG. 11B would be caused by the activation of the diaphragm pump 108 by the air driver 102 but with no product passing around the valve 365. This situation can occur when the product is out or the line needs to be primed. In FIG. 11C the plunger 365 of the valve 365 is fully opened as the product flows through opening 161 and around the plunger 365 to deliver the product. In this embodiment, the product engaging the valve 365 (pressure from the product) opens the valve 365 up farther (approximately 3 to 4 mm in one embodiment) than the valve 365 would open in response to just the pressure from the air driver 102. For example, in one embodiment, the valve would only open approximately 0.5 mm in response to the air driver 102 as illustrated in FIG. 11B. This design allows for the determination between when just the air driver 102 is opening the valve 365 and when the air driver 102 and product are opening the valve 365. When valve 365 is in the position illustrated in FIG. 11C, sensor 118 no longer detects the magnetic field of the magnet 365 (or detects a very small magnetic field) thereby indicating product is passing through the valve 365. The changes in the magnetic field (falling to rising and rising to falling (turning points)) are used to determine the state of the valve. In an embodiment, pump signals (diaphragm pulses) are sent to the controller 124 by the sensor 118. The controller 124 uses the turning points in the magnetic field to determine the delivery of the product (diaphragm pump pumping product).

Figure 12:
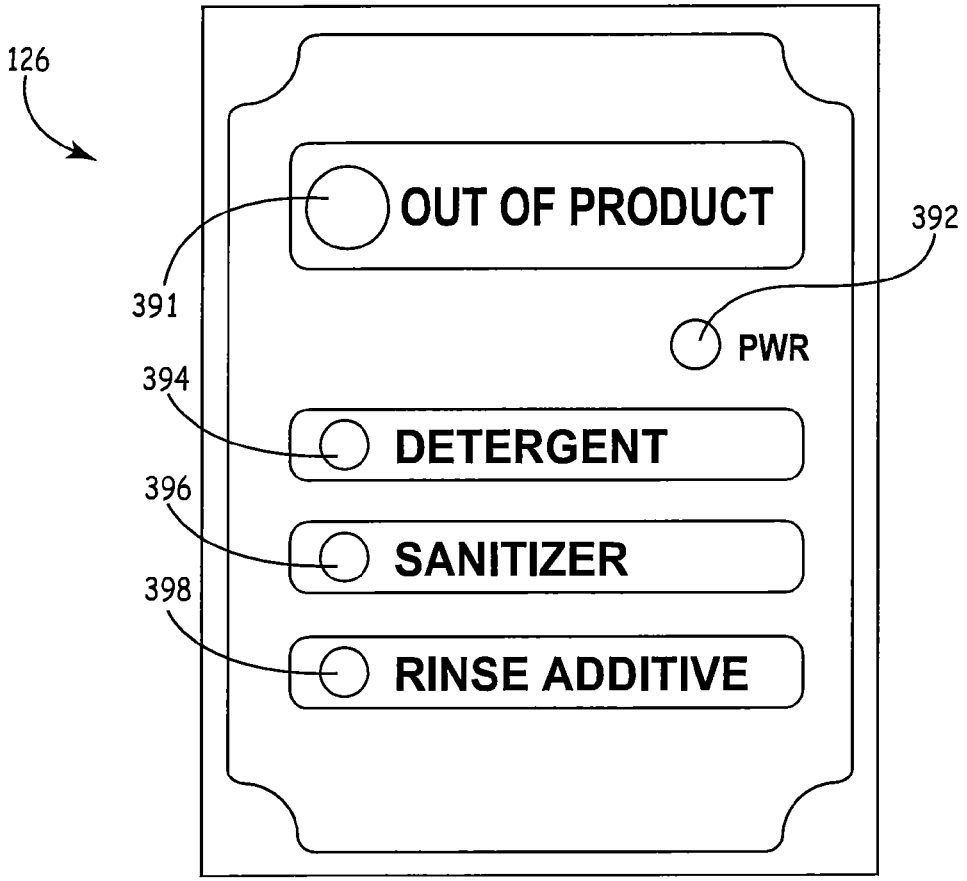
FIG. 12 is a front view of a display/alarm of one embodiment of the present invention.

FIG. 12 illustrates one embodiment of a display/alarm 126. In this embodiment, a plurality of lights 391, 394, 396, 398 and 392 are used to indicate the status of delivery system 100. In one embodiment the lights 391, 394, 396, 398 and 392 are LED lights. Although, lights are used it will be understood that other types of signals including but not limited to sounds, switches etc., can be used to convey the status of the delivery system. In this delivery system we have three products, a detergent (product A), a sanitizer (product B) and a rinse additive (product C). When one of the products is out, light 391 is activated. When the power is on, light 392 is activated. In embodiments, the controller 124 of the product delivery and monitoring system 100 activates the lights 391, 394, 396 and 398 with a control signal based on communication signals received from the air pump sensors 116*a*, 116*b* and 116*c* and the diaphragm sensors 118*a*, 118*b* and 118*c*. For example, in one embodiment if the received signals (pulses) from sensors 116*a* and 118*a* indicate pump 102*a* has performed a pressure/vacuum stroke that should cause diaphragm pump 108*a* to pump out product A but a signal from diaphragm sensor does not indicate product was pumped, the controller 124 lights up the out of product light 391 and the detergent light 394 (product A light). In one embodiment, the controller 124 pulses each of the product lights 394, 396 and 398 when confirmed delivery signals from the respective diaphragm sensors 118*a*, 118*b* and 118*c* are received.

Figure 13:
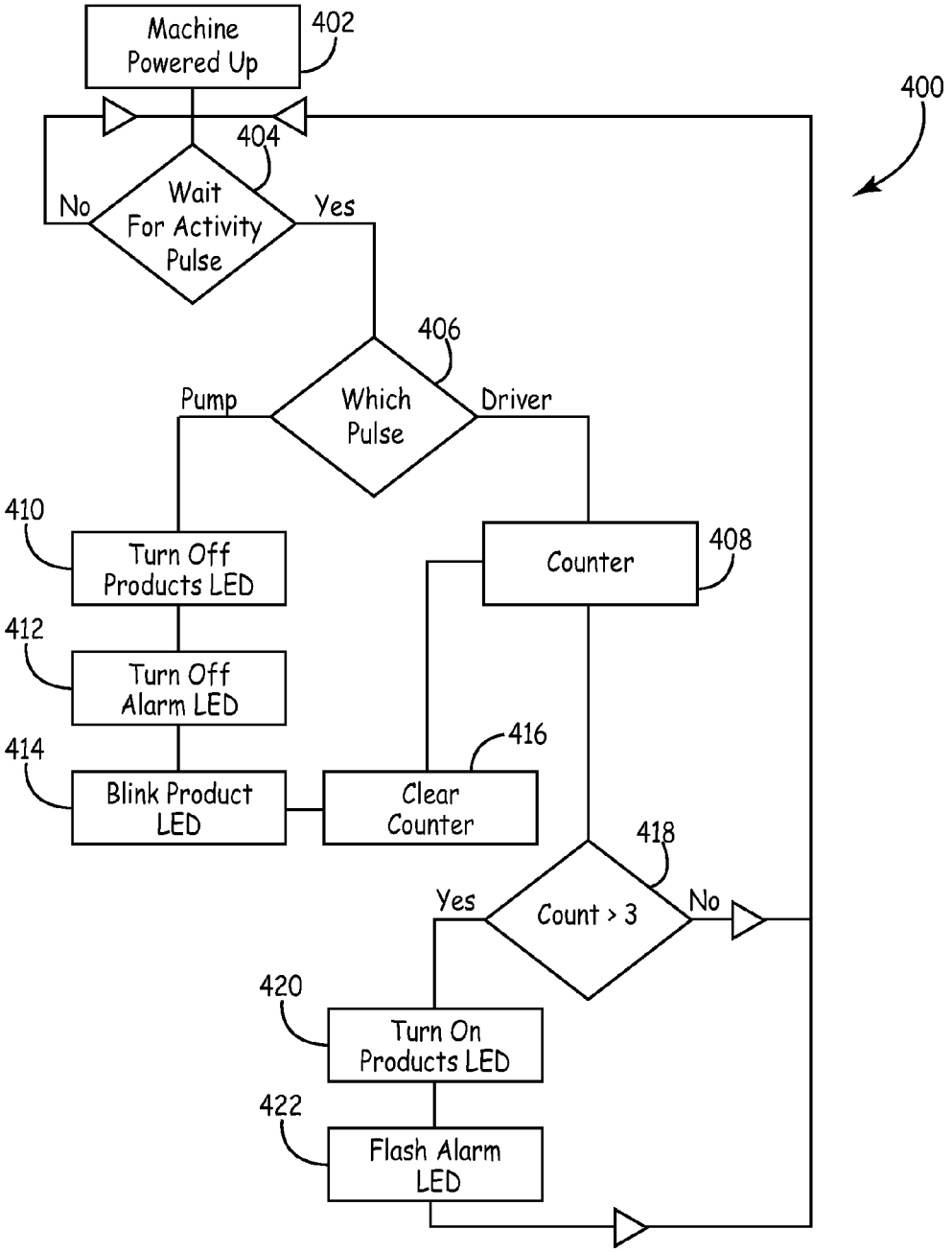
FIG. 13 is a signaling flow diagram of embodiment of the present invention.

An example logic flow diagram 400 used by controller 124 in an embodiment is illustrated in FIG. 13. In particular, logic flow diagram 400 illustrates example logic used for a product indicator in an embodiment. The process starts when the machine is turned on (402). The controller 124 then waits for activity pulses (signals) from either the air pump sensor 116 (driver signals) or the diaphragm pump sensor 118 (pump signals). If an activity pulse received is a pump signal from the diaphragm pump sensor 116, the product light is turned off (410), the alarm light is turned off (412) and the product light is blinked (414) to indicate the product has been delivered. A counter is then cleared (416). Since, the counter (408) will be less than 3, the process will continue at (404) waiting for another activity pulse. If a driver signal from the air pump sensor 116 is detected, the counter is incremented (408). If the count is less than 3 at step (418) the process continues at step (404) waiting for another activity pulse. If more than three activity pulses are detected at (418) (indicating the air pump has gone through three cycles without conformation of product delivery (pump signal), an out of product situation has been determined and the product light is turned on (420) and the alarm light is flashed (422). The method then continues at (404) waiting for an activity pulse. Once, a pump signal has been detected (which will occur when the product is replenished) the product light and alarm light will be turned off as indicated in the logic flow diagram 400. The controller 124 applies this logic to each of the activity pulses received for each product.

In one embodiment, the system 100 includes a function of providing accurate dosages of product to be delivered during a cycle such as a wash cycle. In particular, by knowing the amount of product per pump stroke being delivered and then by providing a select number of pump strokes to deliver, a desired dosage of product during a cycle is delivered. For example, suppose during a wash cycle 16 ml of detergent product is to be dispensed, during a sanitizer cycle 14 ml per cycle of sanitizer product is to be dispensed and during a rinse cycle 3.5 ml of the rinse aid product is to be dispensed. If diaphragm pump 108*a* (detergent pump) dispenses 1.2 ml of product per stroke, a total of thirteen strokes are needed during the wash cycle. If diaphragm pump 108*b* (sanitizer pump) dispenses 1.2 ml per stroke, a total of twelve strokes will be needed during the sanitizer cycle. If diaphragm pump 108*c* (rinse pump) dispenses 0.5 ml per stroke, a total of seven strokes will be needed for the rise cycle. In this embodiment, a service technician can make adjustments to the number of pump strokes via input 125 that is in communication with the controller 124 if the amount of products to be delivered is to be changed. In one embodiment, the input 125 includes dual inline package (DIP) switches.

Figure 14:
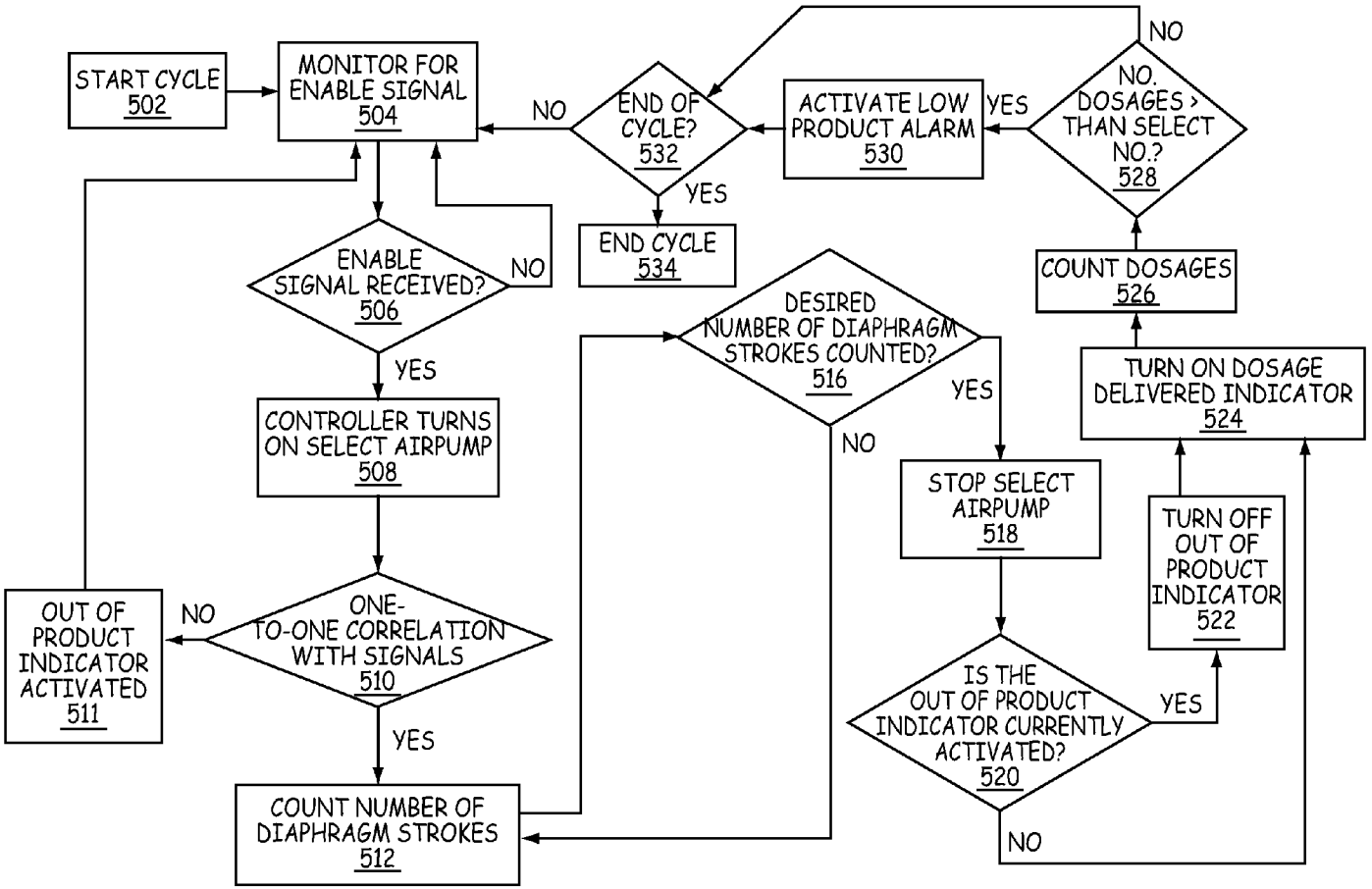
FIG. 14 is a dosing flow diagram of one embodiment of the present invention.

Referring to FIG. 14, a dosing flow diagram of one embodiment is illustrated. This example flow diagram embodiment illustrates a dosing of a product for a cycle. It will be understood that a plurality of cycles each dispensing a different product or multiple products can be implemented in a similar manner. In this example, the process starts with a start of a cycle (502). During the cycle, the system in monitored for an enable signal from the timer system 127 to start the dispensing of a product (504). Once an enable signal is received (506), the controller 124 turns on a select air pump 102 associated with the product to be dispensed (508). The controller 124 then looks for a one-to-one correlation between driver signals from the air pump 102 and pump signals from an associated diaphragm pump 108 (510). If no correlation is detected (510), an out of product indicator is activated (511) and the system then returns to monitoring for another enable signal (504). The out of product indicator can be a light 391 such as a red light or an audible signal or both. If a correlation between the driver signal and the pump signal is detected (meaning the controller 124 has determined the air pump 102 has been activated and a corresponding diaphragm pump 108 has delivered product as result of the activation of the air pump 102), the number of diaphragm strokes are counted (512). In one embodiment this is done by counting the pump signals that indicate product is being pumped through the associated diaphragm pump 108. Once a desired number of diaphragm strokes are counted (516), the controller 124 stops the select air pump 102 (518) to stop the delivery of the select product. In this embodiment, it is then determined if the out of product indicator is currently activated (520). If it is activated (520), the out of product indicator is turned off (522) and a dosage delivered indicator is turned on (524). If the out of product indicator is not currently activated (520), the system merely turns on the dosage delivered indicator (524). The dosage delivered indicator can be a light 394, 396 or 398 such as a green light or audible signal or both.

In one embodiment, a low product alert is implemented into the system. The low product alert is based on the volume of product in a product container 110 and how much product is dispensed during each dosage. Hence, the controller 124 merely subtracts the amount of product being dispensed during each dosage from the total volume of the product in a product container. Once the volume left in product container 110 reaches a select level (say 5%) a low product alert signal is activated. When a technician replaces the product container for a full container, the technician inputs that information into the input 125 and the controller 124 resets a dosing counting function. This embodiment is further illustrated in FIG. 14, wherein after the dosage delivered indicator has been turned on (524), a count of the dosage delivered is tracked (526). The controller 124 then determines if the number of dosages delivered is greater than a select number thereby indicating a select low amount of product is left in the product container. If the number of dosages are not greater than the select number (528), it is determined if it is at the end of a cycle (532). If the number of dosages are greater than a select number (528), a low product alarm is activated (530). The low product alarm can be a light, an audible alarm or similar communication system. It is then determined if it is the end of the cycle (526). If it is not the end of the cycle, the system is monitored for another enable signal (504) from the timer system 127 that would indicate the start of another dosing of a select product. If it is determined to be the end of the cycle (526), the cycle ends (528). Hence, embodiments of the present invention provide a system that provides proof of delivery (POD) of products, out of product alert (OOPA), stroke counting control (SCC) (i.e. accurate dosing) and low product alert (LPA).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A product delivery and monitoring system comprising:

at least one first pump associated with a product;

a first sensor for each first pump, each first pump sensor configured and arranged to monitor the operation of the at least one first pump;

at least one second pump operated by the at least one first pump to deliver the product;

a second pump sensor for each second pump, each second pump sensor configured and arranged to monitor the delivery of the product by the at least one second pump;

a controller in communication with each first pump sensor and each second pump sensor, the controller configured to generate at least one signal based at least in part on comparisons between communications between the controller and a first pump sensor and the controller and an associated second pump sensor; and wherein the controller is further configured to determine at least one of proof of delivery, out of product, dosing amount and low product alert based at least in part on the comparisons between the communications between the controller and the first pump sensor and the controller and the second pump sensor.

2. The product and delivery system of claim 1, wherein the at least one first pump is at least one air pump and the at least one second pump is at least one diaphragm pump.

3. The product and delivery system of claim 1, further comprising:

an indication system in communication with the controller, the controller configured to manipulate the indication system based on the comparison of the signals.

4. A product delivery and monitoring system, the system comprising:

at least one air pump associated with a product;

an air pump sensor for each air pump, each air pump sensor configured and arranged to monitor the operation of the air pump;

at least one diaphragm pump operated by the at least one air pump to deliver the product;

a diaphragm pump sensor for each diaphragm pump, each diaphragm pump sensor configured and arranged to monitor the delivery of the product by the diaphragm pump;

a controller in communication with each air pump sensor and each diaphragm pump sensor, the controller configured to generate at least one control signal based on a comparison of communications from an air pump sensor and an associated diaphragm sensor;

wherein the controller is further configured to determine at least one of proof of delivery, out of product, dosing amount and low product alert based at least in part on the comparisons between the communications between the controller and the air pump sensor and the controller and the diaphragm pump sensor; and an indication system in communication with the controller, the controller configured to manipulate the indication system with the at least one control signal.

5. The system of claim 4, wherein the diaphragm pump further comprises:

a valve configured to open to allow product to pass when pressure is applied to the valve by the product; and a magnet coupled to the valve, the magnet producing a magnetic field, the diaphragm sensor including a hall-effect sensor positioned to detect changes in the strength of the magnetic field as the valve is opened to allow product to pass.

6. The system of claim 4, further comprising:

an input to provide information to the controller.

7. The system of claim 4, further comprising:

a timer system in communication with the controller to set out a timing of operational functions of the system.

8. The system of claim 4, wherein the indication system includes at least one of a light activated by the controller.

9. The system of claim 4, further comprising:

the at least one air pump including a piston received in a chamber;

a first air magnet coupled to the piston of the at least one air pump;

the pump sensor including an air hall-effect sensor positioned and configured to detect a magnetic field generated by the first air magnet;

the at least one diaphragm pump including a cartridge check valve with a check valve; and a second diaphragm magnet coupled to the check valve of the cartridge check valve;

the diaphragm sensor including a diaphragm hall-effect sensor positioned and configured to detect a magnetic field generated by the second diaphragm magnet.

10. The system of claim 9, wherein the controller is further configured to determine the operation of the air pump by monitoring changes in the magnetic field detected by the pump sensor and the delivery of product by diaphragm pump by monitoring changes in the magnetic field detected by the diaphragm sensor.

11. A method of providing a product delivery and monitoring system, the method comprising:

monitoring movement of a piston of at least one air pump that is associated with a product;

monitoring operation of at least one diaphragm pump that delivers the product, each diaphragm pump being configured and arranged to activate in response to movement of a piston of an associated air pump;

comparing activity from the at least one diaphragm pump in response to the activation of an associated air pump;

based at least in part on the comparison, generating a select control signal; and activating an out of product indicator when an one-to-one correlation is not found during the comparison.

12. The method of claim 11, wherein monitoring movement of the piston of the at least one air pump further comprises:

monitoring for changes in a magnetic field produced by a magnet coupled to the piston of the at least one air pump with a hall-effect sensor that is in communication with a controller.

13. The method of claim 11, wherein monitoring the operation of the at least one diaphragm pump further comprises:

monitoring for changes in a magnetic field produced by a magnet in a check valve of the diaphragm pump with a hall-effect sensor that is in communication with the controller.

14. The method of claim 11, further comprising:

once a one-to-one correlation is found during the comparison, counting a number of diaphragm strokes;

when a select number of diaphragm strokes have been counted, turning off the associated air pump; and activating a product dosage delivered indicator.

15. The method of claim 14, further comprising:

counting a number of dosages delivered by the at least one diaphragm pump; and when the number of dosages are greater than a select number, activating a low product indicator.

16. The method of claim 14, further comprising:

adjusting the select number of diaphragm strokes that make up a dosage.

17. A method of providing a product delivery and monitoring system, the method comprising:

monitoring movement of a piston of at least one air pump that is associated with a product;

monitoring operation of at least one diaphragm pump that delivers the product, each diaphragm pump being configured and arranged to activate in response to movement of a piston of an associated air pump;

comparing activity from the at least one diaphragm pump in response to the activation of an associated air pump; and based at least in part on the comparison, generating a select control signal; and activating at least one of an out of product indicator, proof of delivered product indicator and a low product indicator with the select control signal.

* * * * *